United States Patent [19]

Huggins

[11] 4,391,842

[45] Jul. 5, 1983

[54] METHOD OF DEVELOPMENT

[75] Inventor: Raymond W. Huggins, Pittsford, N.Y.

[73] Assignee: Xerox Corporation, Stamford, Conn.

[21] Appl. No.: 286,915

[22] Filed: Jul. 27, 1981

Related U.S. Application Data

[63] Continuation of Ser. No. 86,624, Oct. 19, 1979, abandoned.

[51] Int. Cl.[3] ..... B05D 1/04; B05D 1/06

[52] U.S. Cl. ..... 427/14.1; 118/657; 118/658; 427/27

[58] Field of Search ..... 118/657, 658; 427/14.1, 427/27

[56] References Cited

U.S. PATENT DOCUMENTS 3,570,453 3/1971 Nuzum ..... 118/637

3,872,829 3/1975 Rattin ..... 118/637

*Primary Examiner*—Bernard D. Pianalto

*Attorney, Agent, or Firm*—H. Fleischer; J. E. Beck; R. Zibelli

[57] ABSTRACT

An apparatus in which a latent image recorded on an image bearing member is developed by transporting an electrically conductive developer material into contact therewith in a development zone. The pressure applied on the developer material in the development zone is controlled so as to maintain the conductivity thereof at a selected level.

5 Claims, 6 Drawing Figures

METHOD OF DEVELOPMENT

This is a continuation, of application Ser. No. 086,624, filed Oct. 19, 1979, now abandoned.

This invention relates generally to an electrophotographic printing machine, and more particularly concerns an apparatus for developing a latent image.

In general, electrophotographic printing utilizes a photoconductive member which is charged to a substantially uniform potential to sensitize the surface thereof. The charged portion of the photoconductive surface is exposed to a light image of an original document being reproduced. In this way, an electrostatic latent image is recorded on the photoconductive member which corresponds to the informational areas contained within the original document. After the electrostatic latent image is recorded on the photoconductive member, the latent image is developed by bringing a developer material into contact therewith. This forms a powder image on the photoconductive member which is subsequently transferred to a copy sheet. Finally, the copy sheet is heated to permanently affix the powder image thereto in image configuration.

Frequently, the developer material comprises toner particles adhering triboelectrically to carrier granules. In many cases, the carrier granules are electrically conductive. This two component mixture is brought into contact with the latent image. The toner particles are attracted from the carrier granules to the latent image forming a powder image thereof. Alternatively, single component developer materials may be employed. Single component developer materials comprise electrically conductive particles. Generally, the carrier granules of the two component mixture and the particles of the single component developer material are magnetic. This permits the use of magnetic brush development in the printing machine.

Hereinbefore, it has been difficult to control the conductivity of the developer material. It has been found that conductivity directly affects the capability of the system in developing differing types of images recorded on the photoconductive surface. For example, large solid areas are difficult to develop with a low conductive developer material. Contrariwise, it has been found that a high conductive developer material optimizes solid area development. However, highly conductive materials frequently develop lines poorly, whereas developer materials having a lower conductivity optimize line development. Ideally, it is desirable to be capable of controlling the conductivity of the developer material so as to optimize development of both solid areas and lines.

Various approaches have been devised to improve development. The following disclosures appear to be relevant:

Research Disclosure Journal
April, 1978
Page 4 No. 16823
Disclosed by: Paxton
U.S. Pat. No. 4,267,797
Issued May 19, 1981
Patentee: Huggins The pertinent portions of the foregoing disclosures may be briefly summarized as follows:

Paxton describes a magnetic brush system in which the conductivity of the developer material is adjusted by varying the amount or density of the developer material in the nip. To provide improved copy contrast and fringiness between solid area and line development, the amount of developer in the nip and/or the electrical bias applied to the magnetic brush developer roller is selectively adjusted.

Huggins describes a magnetic development system in which the developer materials conductivity is controlled by regulating the intensity of the magnetic field and/or the spacing between the developer roll and photoconductive surface.

In accordance with the present invention, there is provided an apparatus for developing a latent image recorded on an image bearing member. The apparatus includes means for transporting an electrically conductive developer material into contact with the image bearing member in a development zone to develop the latent image recorded thereon. Means for provided for controlling the pressure applied on the developer material in the development zone so as to maintain the conductivity thereof at a selected level.

Other aspects of the present invention will become apparent as the following description proceeds and upon reference to the drawings, in which:

While the present invention will hereinafter be described in connection with various embodiments and methods of use thereof, it will be understood that it is not intended to limit this invention to these embodiments or methods of use. On the contrary, it is intended to cover all alternatives, modifications and equivalents as may be included within the spirit and scope of the invention as defined by the appended claims.

Figure 1:
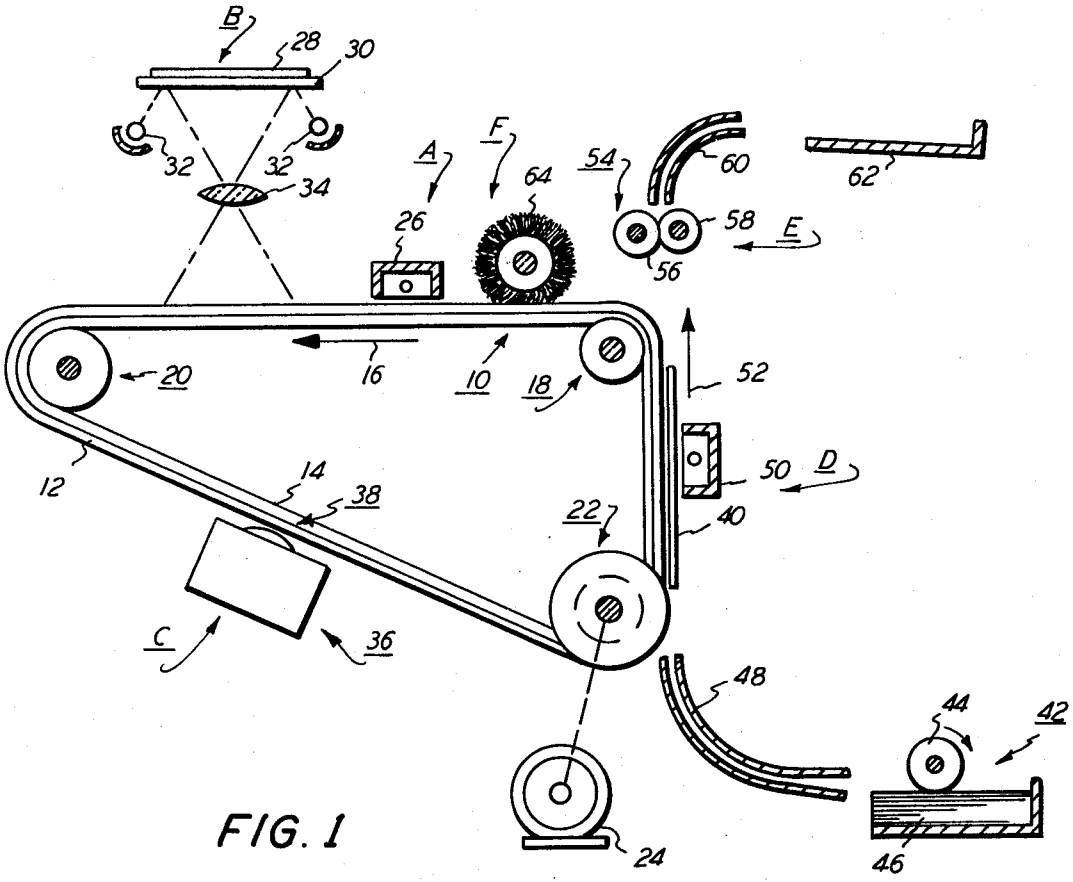
FIG. 1 is a schematic elevational view showing an electrophotographic printing machine incorporating the features of the present invention therein.

For the general understanding of the features of the present invention, reference is made to the drawings. In the drawings, like reference numerals have been used throughout to designate identical elements. FIG. 1 schematically depicts the various components of an illustrative electrophotographic printing machine incorporating the development apparatus of the present invention therein. It will become apparent from the following discussion that this development apparatus is equally well suited for use in a wide variety of electrostatographic printing machines and is not necessarily limited in its application to the particular embodiment shown herein.

Inasmuch as the art of electrophotographic printing is well known, the various processing stations employed in the FIG. 1 printing machine will be shown hereinafter schematically and their operation described briefly with reference thereto.

DETAILED DESCRIPTION OF THE DRAWING

Turning now to FIG. 1, the electrophotographic printing machine depicted thereat employs a belt 10 having a photoconductive surface 12 deposited on a conductive substrate 14. Preferably, photoconductive surface 12 comprises a transport layer having small molecules of m-TBD dispersed in a polycarbonate and a generation layer of trigonal selenium. Conductive substrate 14 is made preferably from aluminized Mylar which is electrically grounded. Belt 10 moves in the direction of arrow 16 to advance successive portions of photoconductive surface 12 through the various processing stations disposed about the path of movement thereof. In order to facilitate the movement of belt 10 in a pre-determined path, support is provided by stripping roller 18, tension roller 20 and drive roller 22. As illustrated in FIG. 1, belt 10 is entrained about stripping roller 18, tension roller 20 and drive roller 22. Drive roller 22 is mounted rotatably and in engagement with belt 10. Roller 22 is coupled to motor 24 by suitable means such as a belt drive. Motor 24 rotates roller 22 to advance belt 10 in the direction of arrow 16. Drive roller 22 includes a pair of opposed, spaced edge guides. The edge guides define a space therebetween which determines the desired path of movement for belt 10. Belt 10 is maintained in tension by a pair of springs (not shown) resiliently urging tension roller 20 against belt 10 with the desired spring force. Both stripping roller 18 and tension roller 20 are mounted rotatably. These rollers act as idlers which rotate freely as belt 10 moves in the direction of arrow 16.

With continued reference to FIG. 1, initially a portion of belt 10 passes through charging station A. At charging station A, a corona generating device, indicated generally by the reference numeral 26, charges photoconductive surface 12 of belt 10 to a relatively high, substantially uniform potential.

Next, the charged portion of photoconductive surface 12 is advanced through exposure station B. At exposure station B, an original document 28 is positioned face-down upon transparent platen 30. Lamps 32 flash light rays onto original document 28. The light rays reflected from original document 28 are transmitted through lens 34 forming a light image thereof. Lens 34 focuses the light image onto charged portion of photoconductive surface 12 to selectively dissipate the charge thereon. This records an electrostatic latent image on photoconductive surface 12 which corresponds to the informational areas contained within the original document.

Thereafter, belt 10 advances the electrostatic latent image recorded on photoconductive surface 12 to development station C. At development station C, a magnetic brush development system, indicated generally by the reference numeral 36, transports a developer material into contact with photoconductive surface 12. More specifically, roller 38 advances the developer material into contact with photoconductive surface 12 so as to form a powder image on photoconductive surface 12 of belt 10. One skilled in the art will appreciate that either a two component developer material or a single component developer material may be employed in development system 36. The detailed structure of magnetic brush development system 36 will be described hereinafter with reference to FIGS. 2 through 5, inclusive.

Belt 10 then advances the powder image to transfer station D. At transfer station D, a sheet of support material 40 is moved into contact with the powder image. The sheet of support material is advanced to transfer station D by a sheet feeding apparatus 42. Preferably, sheet feeding apparatus 42 includes a feed roll 44 contacting the uppermost sheet of stack 46. Feed roll 44 rotates so as to advance the uppermost sheet from stack 46 into chute 48. Chute 48 directs the advancing sheet of support material into contact with photoconductive surface 12 of belt 10 in a timed sequence so that the powder image developed thereon contacts the advancing sheet of support material at transfer station D.

Transfer station D includes a corona generating device 50 which sprays ions onto the backside of sheet 40. This attracts the powder image from photoconductive surface 12 to sheet 40. After transfer, the sheet continues to move in the direction of arrow 52 onto a conveyor (not shown) which advances the sheet to fusing station E.

Fusing station E includes a fuser assembly, indicated generally by the reference numeral 54, which permanently affixes the transferred powder image to sheet 40. Preferably, fuser assembly 54 includes a heated fuser roller 56 and a back-up roller 58. Sheet 40 passes between fuser roller 56 and back-up roller 58 with the powder image contacting fuser roller 56. In this manner, the powder image is permanently affixed to sheet 40. Although a heated pressure system has been described for fixing the particles to sheet 40, a cold pressure system may be utilized in lieu thereof. After fusing, chute 60 guides the advancing sheet 40 to catch tray 62 for subsequent removal from the printing machine by the operator.

Invariably, after the sheet 40 is separated from photoconductive surface 12 of belt 10, some residual particles remain adhering thereto. These residual particles are removed from photoconductive surface 12 at cleaning station F. Cleaning station F includes a preclean corona generating device (not shown) and a rotatably mounted fiberous brush 64 in contact with photoconductive surface 12. The pre-clean corona generator neutralizes the charge attracting the particles to the photoconductive surface. The particles are then cleaned from photoconductive surface 12 by the rotation of brush 64 in contact therewith. Subsequent to cleaning, a discharge lamp (not shown) floods photoconductive surface 12 with light to dissipate any residual electrostatic charge remaining thereon prior to the charging thereof for the next successive imaging cycle.

Although the illustrative electrophotographic printing machine heretofore described employs a photoconductive belt, one skilled in the art will appreciate that any suitable photoconductive member may be used, e.g. a drum.

It is believed that the foregoing description is sufficient for purposes of the present application to illustrate the general operation of an electrophotographic printing machine.

Figure 2:
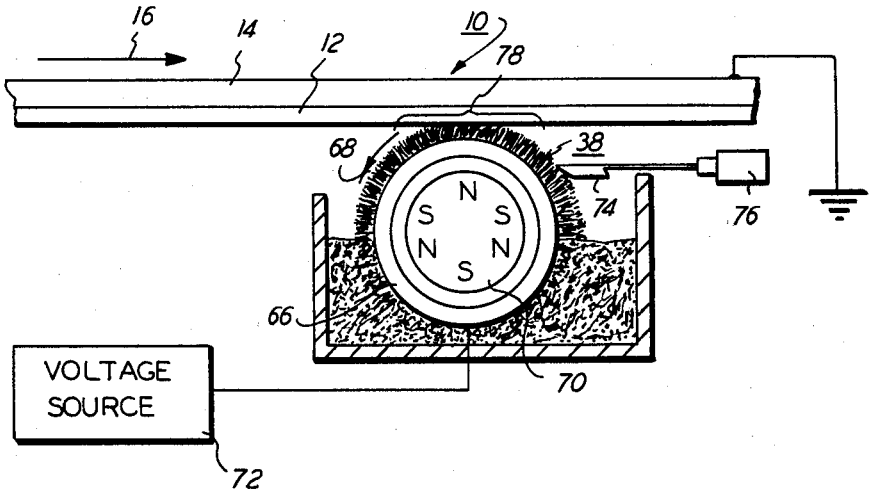
FIG. 2 is a schematic elevational view depicting one embodiment of the development system employed in the FIG. 1 printing machine.

Referring now to the specific subject matter of the present invention, FIG. 2 depicts one embodiment of development system 36 in greater detail. As depicted thereat, developer roller 38 includes a non-magnetic tubular member 66 journaled for rotation. Preferably, tubular member 66 is made from aluminum having the exterior circumferential surface thereof roughened. Tubular member 66 rotates in the direction of arrow 68. An elongated magnetic rod 70 is positioned concentrically within tubular member 66 being spaced from the interior circumferential surface thereof. Magnetic rod 70 has a plurality of magnetic poles impressed thereon. The magnetic field generated by magnetic rod 70 attracts the developer material to the exterior circumferential surface of tubular member 66. As tubular member 66 rotates in the direction of arrow 68, the developer material is transported into contact with photoconductive surface 12 to form a powder image on photoconductive surface 12. Tubular member 66 is electrically biased by voltage source 72. Voltage source 72 generates a potential having a suitable polarity and magnitude to electrically bias tubular member 66 to the desired level. Preferably, voltage source 72 electrically biases tubular member 66 to a level intermediate to that of the background or non-image area voltage levels and that of the electrostatic latent image, e.g. between 50 and 350 volts. Blade 74 has the leading edge thereof closely adjacent to tubular member 66 so as to meter or control the quantity of developer material being transported thereby. Blade 74 is mounted on the armature of solenoid 76. By energizing solenoid 76 to the appropriate level, the gap between the leading edge of blade 74 and tubular member 66 may be regulated. In this manner, the quantity of developer material being transported into development zone 78 may be regulated. Thus, the mass flow rate of the developer material in development zone 78 is controlled inasmuch as tubular member 66 is rotating at a substantially constant angular velocity. It is clear that one skilled in the art will appreciate that many different types of techniques may be employed to control the quantity of developer material entering the development zone. However, the significant feature described herein with reference to the embodiment depicted in FIG. 2 is that the mass flow rate of the developer material in the development zone is regulated by controlling the quantity of developer material entering the development zone. This, in turn, controls the pressure being applied to the developer material. Inasmuch as the pressure being applied on the developer material is being controlled, the conductivity of the developer material is being maintained at a selected level. As the gap is varied, i.e. by moving the leading edge of blade 74 through energizing solenoid 76 appropriately, the mass flow rate and, in turn, the pressure applied on the developer material is regulated. In this manner, the conductivity of the developer material may be varied to achieve the desired level so as to optimize development of either lines or solid areas in the electrostatic latent image.

Figure 3:
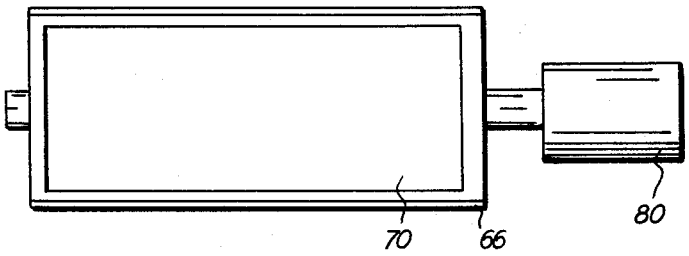
FIG. 3 is a schematic elevational view illustrating the drive system for the developer roller of the FIG. 2 development system.

Referring now to FIG. 3, there is depicted the drive system for magnetic brush developer roller 38. As depicted thereat, the drive system includes a constant speed motor 80 coupled to tubular member 66. Tubular member 66 is mounted on suitable bearings so as to be rotatable. Magnetic rod 70 is mounted substantially fixed interiorly of tubular member 66. Excitation of motor 80 rotates tubular member 66 in the direction of arrow 68 (FIG. 2). In this way, the developer mixture moves in the direction of arrow 68 into development zone 78. Alternatively, particularly when a single component developer material is employed, motor 80 rotates magnetic rod 70 while tubular member 66 remains stationary. It is apparent to one skilled in the art that a variable speed motor may be used in lieu of the constant speed motor described hereinbefore. When a variable speed motor is used, the gap remains constant and the velocity of the developer material entering the development zone is controlled by regulating the angular velocity of tubular member 66 or magnetic rod 70. The speed of the motor is regulated by adjusting the output of the power supply coupled thereto.

Figure 4:
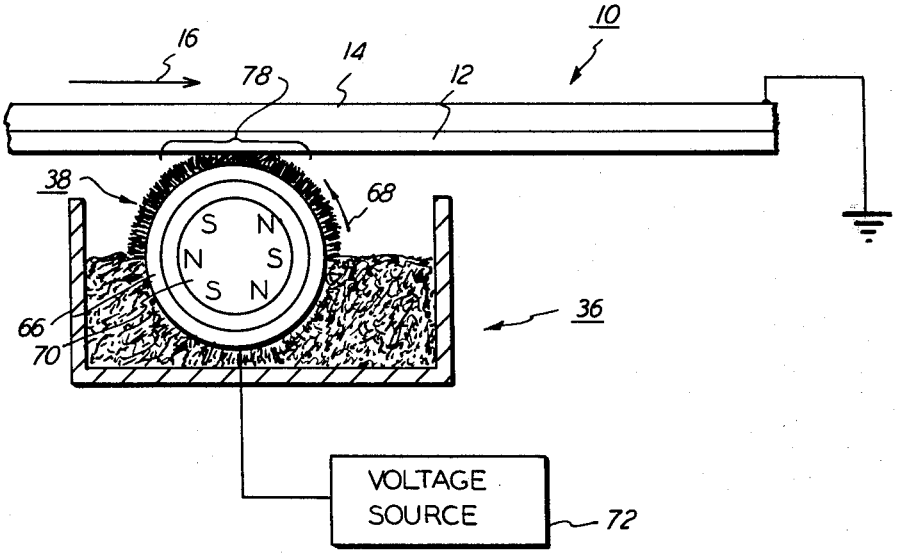
FIG. 4 is a schematic elevational view showing another embodiment of the development system used in the FIG. 1 printing machine.

Referring now to FIG. 4, there is shown another embodiment of development system 36. As depicted thereat, developer roller 38 includes a non-magnetic tubular member 66 journaled for rotation. Once again, tubular member 66 is preferably made from aluminum having the exterior circumferential surface thereof roughened. Tubular member 66 rotates in the direction of arrow 68. Elongated magnetic rod 70 is positioned concentrically within tubular member 66 being spaced from the interior circumferential surface thereof. Magnetic rod 70 has a plurality of magnetic poles impressed thereon. However, magnetic rod 70 is no longer fixed, as was the case in the embodiment depicted in FIG. 2. In the embodiment depicted in FIG. 4, magnetic rod 70 is capable of being indexed so as to orient the magnetic poles relative to development zone 78. In this way, the intensity of the magnetic field in development zone 78 may be varied. By varying the intensity of the magnetic field, the pressure applied on the developer material in development zone 78 is adjusted to a suitable level so as to obtain the desired conductivity thereof. In operation, magnetic rod 70 is indexed so as to orient the poles thereon relative to development zone 78. This adjusts the intensity of the magnetic field in development zone 78 to the desired level. This insures that the pressure applied on the developer material in development zone 78 is at the selected level. In this manner, the conductivity of the developer material is maintained at the desired level. The magnetic field generated by magnetic rod 70 attracts the developer material to the exterior circumferential surface of tubular member 66. As tubular member 66 rotates in the direction of arrow 68, the developer material is moved into contact with photoconductive surface 12 to form a powder image. Once again, voltage source 72 electrically biases tubular member 66 to a suitable magnitude and potential, e.g. between 50 and 350 volts. Preferably, magnetic rod 70 is made from barium ferrite having magnetic poles impressed about the circumferential surface thereof. The strength of the magnetic poles may also be suitably selected. However, once these poles are at a selected value, only by rotating magnetic rod 70 relative to development zone 78 may the intensity of the magnetic field in the development zone be adjusted.

Figure 5:
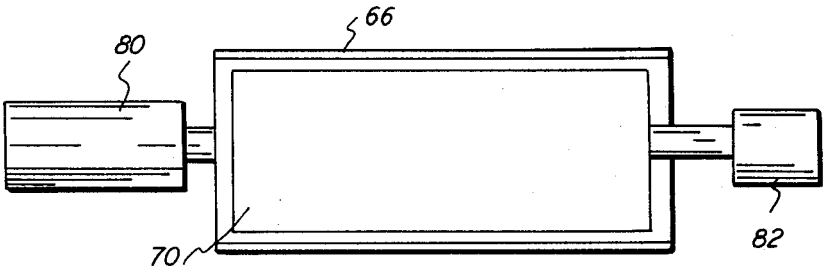
FIG. 5 is a schematic elevational view depicting the drive system and magnet indexing system for the developer roller of the FIG. 4 development system.

Referring now to FIG. 5, there is shown the indexing system for magnetic rod 70 and the drive system for tubular member 66. As depicted thereat, a constant speed motor 80 is coupled to tubular member 66. Tubular member 66 is mounted on suitable bearings so as to be rotatable. Magnetic rod 70 is also mounted on suitable bearings being coupled to stepping or indexing motor 82. Energization of stepping motor 82 rotates magnetic rod 70 through a discrete angle so as to orient the magnetic poles impressed thereon relative to the development zone. In this way, the intensity of the magnetic field in the development zone is controlled so as to maintain the pressure applied on the developer material at the desired level. This, in turn, regulates the conductivity of the developer material in the development zone. Excitation of motor 80 rotates tubular member 66 in the direction of arrow 68 (FIG. 4) and transports the developer material in the direction of arrow 68.

By way of example, a suitable two component developer material comprises magnetic, electrically conductive carrier granules having toner particles adhering thereto triboelectrically. The carrier granules include a ferromagnetic core having a thin layer of magnetite overcoated with a layer of resinous material. Suitable resins include poly(vinylidene fluoride) and poly(vinylidene fluoride-co-tetrafluoroethylene). The developer composition can be prepared by mixing the carrier granules with the toner particles. Suitable toner particles are prepared by finely grinding a resinous material and mixing it with a coloring material. By way of example, the resinous material may be a vinyl polymer such as polyvinyl chloride, polyvinylidene chloride, polyvinyl acetate, polyvinyl acetals, polyvinyl ether, and polyacrylic. Suitable coloring materials may be, amongst others, chromogen black and solvent black. The developer material comprises about 95 to about 99% by weight of carrier and from about 5 to about 1% by weight of toner, respectively. These and other materials are disclosed in U.S. Pat. No. 4,076,857 issued to Kasper et al. in 1978, the relevant portions thereof being hereby incorporated into the present application.

Figure 6:
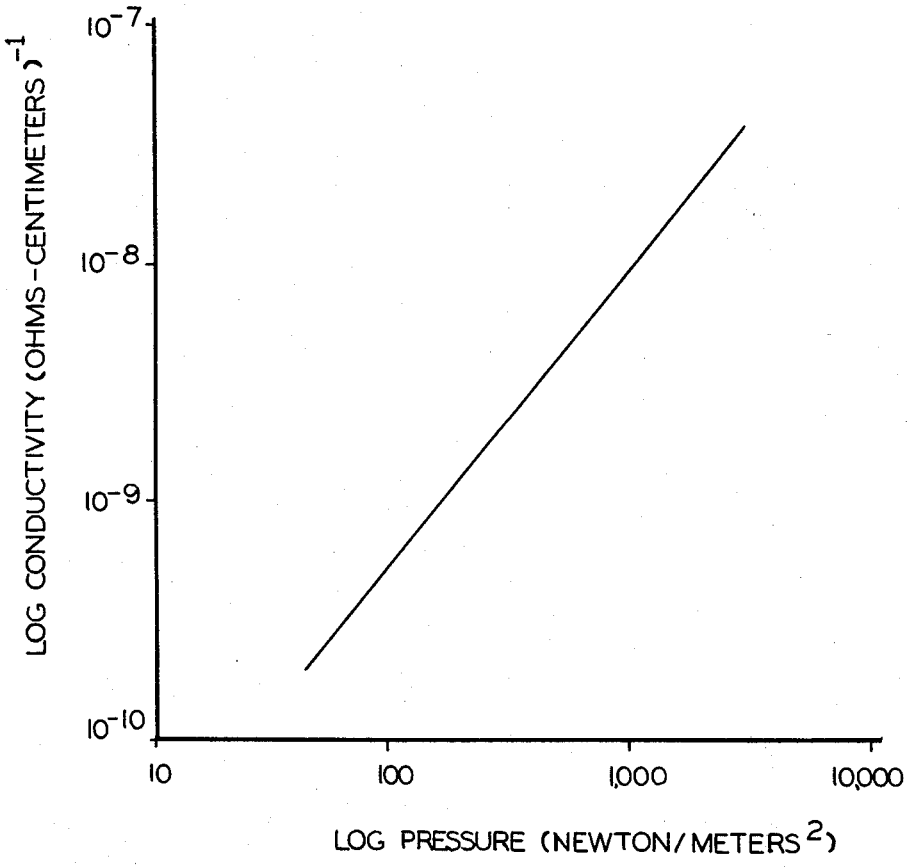
FIG. 6 is a graph showing developer material conductivity as a function of the pressure applied thereon in the development zone.

Referring now to FIG. 6, there is shown a logarithmic plot of conductivity as a function of pressure. The graph of FIG. 6 reflects a developer roll spacing with respect to the photoconductive surface of about 4 millimeters. As shown thereat, the conductivity varies from about $2\times10^{-10}$ (ohm-centimeters)$^{-1}$ at a pressure of about 45 newton/meters$^2$ to about $4\times10^{-8}$ (ohm-centimeters)$^{-1}$ at a pressure of about 3000 newton/meters$^2$. The radial magnetic field is about 290 gauss with the tangential magnetic field being about 320 gauss. The pressure on the developer material varies by changing the magnetic field strength and/or the mass flow rate. Massflow rate may be regulated by controlling the quantity of material or flow rate. Thus, if the metering gap is controlled, the quantity of particles in the development zone is regulated. Alternatively the angular velocity of the developer roller may be regulated to control the flow of particles. In either case it is clear that the conductivity of the developer material varies as a function of the pressure applied thereon in the development zone.

In recapitulation, it is evident that the development apparatus of the present invention optimizes development by regulating the pressure applied on the developer material in the development zone so as to control the conductivity of the developer material thereat. Pressure may be controlled by regulating the mass rate flow or by regulating the intensity of the magnetic field in the development zone. In this manner, both the solid areas and lines of an electrostatic latent image may be optimumly developed.

It is, therefore, evident, that there has been provided, in accordance with the present invention, an apparatus for controlling the conductivity of the developer material in the development zone so as to optimize development of solid areas and lines within an electrostatic latent image. This apparatus fully satisfies the aims and advantages hereinbefore set forth. While this invention has been described in conjunction with specific embodiments and methods of use thereof, it is evident that many alternatives, modifications, and variations will be apparent to those skilled in the art. Accordingly, it is intended to embrace all such alternatives, modifications, and variations as fall within the spirit and broad scope of the appended claims.

What is claimed is:

1. A method of developing a latent image recorded on an image bearing member with an electrically conductive developer material, including the steps of:

transporting the electrically conductive developer material into contact with the image bearing member in a development zone on a rotating tubular member by generating a magnetic field to attract the developer material to the tubular member; and increasing the intensity of the magnetic field between the image bearing member and the tubular member to apply a selected pressure to the developer material to adjust the electrical conductivity of the developer material to enhance solid area latent image development, or decreasing the intensity of the magnetic field between the image bearing member and the tubular member to apply a selected pressure to the developer material to adjust the electrical conductivity of the developer material to enhance line latent image development.

2. A method as recited in claim 1, wherein said step of changing includes said step of orienting a magnetic member disposed interiorly of the tubular member to position the magnetic poles thereon relative to the development zone so as to regulate the intensity of the magnetic field thereat.

3. A method of printing as recited in claim 1, wherein said step of changing includes said step of orienting a magnetic member disposed interiorly of the tubular member to position the magnetic poles thereon relative to the development zone so as to regulate the intensity of the magnetic field thereat.

4. A method of electrophotographic printing, including the steps of:

transporting an electrically conductive developer material into contact with a photoconductive surface on a rotating non-magnetic tubular member by generating a magnetic field to attract the developer material to the tubular member so the developer material moves into a development zone; and adjusting the intensity of the magnetic field to apply relatively more pressure to the developer material to increase the electrical conductivity of the developer material to enhance development of solid area latent images, or adjusting the intensity of the magnetic field to apply relatively less pressure to the developer material to decrease the electrical conductivity of the developer material to enhance development of line latent images.

5. A method for developing a latent image recorded on an image bearing member with an electrically conductive developer material comprising the steps of:

transporting the electrically conductive developer material into contact with the image bearing member in a development zone to develop the latent image recorded thereon;

generating a magnetic field to attract the developer material to said transporting means; and adjusting the pressure applied on the developer material in the development zone to apply relatively more pressure on the developer material to increase the electrical conductivity of the developer material to enhance development of solid area latent images and to decrease the pressure applied on the developer material to apply relatively less pressure on the developer material to decrease the electrical conductivity of the developer material to enhance development of line latent images.

* * * * *